US011737516B1

(12) United States Patent
Sandborn

(10) Patent No.: US 11,737,516 B1
(45) Date of Patent: Aug. 29, 2023

(54) FOOTWEAR WITH SECURELY INTERCHANGEABLE HEEL PORTIONS

(71) Applicant: Benjamin Sterling Sandborn, Honolulu, HI (US)

(72) Inventor: Benjamin Sterling Sandborn, Honolulu, HI (US)

( * ) Notice: Subject to any disclaimer, the term of this patent is extended or adjusted under 35 U.S.C. 154(b) by 0 days.

(21) Appl. No.: 17/666,475

(22) Filed: Feb. 7, 2022

(51) Int. Cl.

| | |
|---|---|
| ***A43B 3/24*** | (2006.01) |
| ***A43B 21/47*** | (2006.01) |
| ***A43B 21/42*** | (2006.01) |
| ***A43B 1/10*** | (2006.01) |
| ***A43B 21/52*** | (2006.01) |
| ***A43B 3/10*** | (2006.01) |

(52) U.S. Cl.
CPC ..... *A43B 21/42* (2013.01); *A43B 1/10* (2013.01); *A43B 3/108* (2013.01); *A43B 3/246* (2013.01); *A43B 21/47* (2013.01); *A43B 21/52* (2013.01)

(58) Field of Classification Search
CPC ..... A43B 3/26; A43B 3/246; A43B 3/108; A43B 3/128; A43B 21/42; A43B 21/47; A43B 21/48
See application file for complete search history.

(56) References Cited

U.S. PATENT DOCUMENTS

| | | | | |
|---|---|---|---|---|
| 3,724,104 | A * | 4/1973 | Eder | A43B 13/28 36/32 R |
| 4,150,464 | A | 4/1979 | Tracy | |
| 5,373,649 | A * | 12/1994 | Choi | A43B 21/40 36/36 R |
| 5,419,060 | A * | 5/1995 | Choi | A43B 21/48 36/42 |
| 6,349,486 | B1 * | 2/2002 | Lin | A43B 3/122 36/15 |
| 6,430,846 | B1 * | 8/2002 | Lin | A43B 3/126 24/640 |
| 7,765,722 | B2 | 9/2010 | Berrins | |
| 8,011,119 | B2 | 9/2011 | Tvoua et al. | |
| 9,603,410 | B2 * | 3/2017 | McNamara-Schwartz | A43B 3/246 |
| 11,044,962 | B2 | 9/2021 | Cheung | |
| 2013/0145651 | A1 * | 6/2013 | Bathum | A43B 3/101 36/43 |
| 2017/0231316 | A1 | 8/2017 | Sethi | |

FOREIGN PATENT DOCUMENTS

| | | | |
|---|---|---|---|
| CN | 103222708 | A | 7/2013 |
| CN | 203851879 | U | 10/2014 |
| CN | 213045562 | U | 4/2021 |
| JP | 3155001 | U | 11/2009 |
| KR | 20130038114 | A | 4/2013 |
| KR | 20130093968 | A | 8/2013 |
| TW | M363225 | U | 8/2009 |
| TW | M438141 | U | 10/2012 |

* cited by examiner

*Primary Examiner* — Ted Kavanaugh
(74) *Attorney, Agent, or Firm* — Martin E. Hsia; Keri Ann K. S. Krzykowski

(57) ABSTRACT

Footwear with a heel portion having a clasp member with resilient arms having locking tabs that engage with locking slots in a receptacle member in a main portion, when the heel portion abuts against the main portion. The locking tabs disengage from the locking slots when simultaneously squeezed together by a tool that extends through locking tab access holes on both sides of the main portion. The locking tab access holes are too small for a child's fingers to enter. The clasp member and receptacle member can be in either the heel portion or the main portion.

5 Claims, 8 Drawing Sheets

FOOTWEAR WITH SECURELY INTERCHANGEABLE HEEL PORTIONS

TECHNICAL FIELD

This invention relates to footwear having a main portion with securely interchangeable heel portions for replacement when worn out, for growing children, or for other reasons.

BACKGROUND ART

Footwear that extends, to accommodate growing feet as children grow, such as with interchangeable heel portions, or insertable and removable sole portions (portions of a sole that can be inserted into or between a heel portion or a main portion, or into another sole portion, and removed), is known. For simplicity, interchangeable heel portions and insertable and removable sole portions are sometimes collectively referred to as heel portions.

Footwear made from rubber or other flexible and compressible material, hereinafter called "elastomeric" material, is very popular for comfort and inexpensive to manufacture. However, because it is flexible and compressible, elastomeric material is not structurally as strong as rigid material.

Children play with anything within reach, so children will play with footwear with interchangeable heel portions, which can result in loss of the heel portions, if those portions are not securely fastened to the main portions strongly enough to prevent children from pulling the portions of the footwear apart. Also, footwear is subjected to strong forces when it is used. However, because elastomeric materials are flexible and compressible and therefore not very strong, it is difficult to make any fastener joining heel portions to main portions of elastomeric footwear strong enough to withstand pulling apart or forces from use, especially as the footwear wears down.

Also, it is well known that the heel portion of footwear tends to wear out faster than the main portion of footwear, so elastomeric material in a heel portion will likely wear out even faster than in other portions of the footwear.

U.S. Pat. No. 4,150,464 to Tracy, incorporated herein by reference, discloses a buckle having separable cooperating receptacle and clasp members, with the receptable member having a pair of locking slots formed in opposing sides, and the clasp member having a pair of resilient arms having locking tabs thereon for releasably engaging the locking slots of the receptacle member.

US Patent application publication 2017/0231316 A1 to Sethi, incorporated herein by reference, discloses an item of footwear with a midsole, an upper releasably coupled to the midsole; and a sole releasably coupled to the midsole. The midsole may be adjustable in length and comprises a front midsole prion and a rear midsole portion held together and supported by a shank. The rear midsole portion includes pins which engage corresponding portions of the front midsole portion to provide lateral support.

China patent publication 213045562U to Quiang, et al, incorporated herein by reference, discloses length adjustable customized slippers with two differently sized heels.

U.S. Pat. No. 8,011,119 B2 to Tvoua et. Al, incorporated herein by reference, discloses personally adjustable footwear with an intermediate portion that is elastically flexible to allow relative longitudinal displacement of the toe portion and heel portion to vary a length of a layer without significant variation in the thickness of the laver.

China patent publication 203851879U to Yonghua, incorporated herein by reference, discloses size-adjustable slippers with a front sole, a rear sole, and a plurality of middle soles of varying sizes, held together with fixing strips and clamping blocks.

Japan patent publication 3155001U, incorporated herein by reference, discloses shoes adjustable in width and length, having a front part and a rear part connected to each other by a connecting member.

Taiwan patent publication TWM363225U to Ming-long, incorporated herein by reference, discloses a shoe structure in which a front shoe section and a rear shoe section have a zigzag joint forming grooves that can be appropriately separated for fine adjustment of the length of the shoe.

Taiwan patent publication TWM438141U to Kuo-Yen, incorporated herein by reference, discloses a variable length slipper having three sections with felt, grooves, through-slots and pins.

Korea patent publication 20130038114A to Jong, incorporated herein by reference, discloses length adjustable footwear having a front-axis and a back-axis with a length adjustment clip in the bottom of the footwear.

Korea patent application 20130093968A to Se Ryeol, incorporated herein by reference, discloses an adjustable length slipper having an adjustment bolt.

China patent application publication 103222708A to Zhonghua, incorporated herein by reference, discloses adjustable dual-purpose slippers having bulges and matching grooves.

U.S. Pat. No. 7,765,722 B2 to Berrins, incorporated herein by reference, discloses a sandal with adjustable straps and interchangeable mix and match straps and insoles.

U.S. patent Ser. No. 11/044,962 B2 to Cheung, incorporated herein by reference, discloses modular shoes with adjustable size.

DISCLOSURE OF INVENTION

In a first presently preferred embodiment, the present invention is a piece of footwear, comprising a main portion having a receptacle member recess in a rear part, and a pair of locking tab access holes in right and left side parts, which lead to the receptacle member recess. The locking tab access holes are less than approximately ¼ inch (approximately 60 millimeters) in width, so that the locking tab access holes are too narrow for a child's finger to go through to reach the receptacle recess. A receptacle member mounted in the receptacle member recess has a pair of locking slots formed in opposing sides of the receptacle member, and the locking slots are in communication with the locking tab access holes. A heel portion has a clasp member recess in a front part.

A clasp member mounted in the clasp member recess has a pair of resilient arms extending outside the clasp member recess. The resilient arms have locking tabs for releasably engaging the locking slots of the receptacle member when the front part of the heel portion abuts against the rear part of the main portion, to securely join the heel portion to the main portion. In this manner, when the front part of the heel portion abuts against the rear part of the main Portion, the locking tabs releasably engage with the locking slots so that the heel portion is securely joined to the main portion. Using a tool that extends through the locking slots to press the locking tabs towards each other releases the locking tabs from the locking slots to allow the heel portion to be separated from the main portion.

Preferably, the main portion and the heel portion comprise an elastomeric material, and the receptacle member and the clasp member comprise a resilient material.

Preferably also, the receptacle member and the clasp member are embedded in the elastomeric material of the main portion and the heel portion.

In another presently preferred embodiment, the invention is a piece of footwear, comprising a main portion having a receptacle recess in a rear part, and a pair of locking tab access holes in right and left side parts leading to the receptacle recess, and a retaining member hole in a bottom part, leading to the receptacle recess. The locking tab access holes are less than approximately ¼ inch (approximately 60 millimeters) in diameter, so that the locking tab access holes are too narrow for a child's finger to go through the locking tab access holes to reach the receptacle recess. A receptacle member in the receptacle recess has a pair of locking slots formed in opposing sides of the receptacle member, and the locking slots are in communication with the locking tab access holes. A heel portion has a clasp member recess in a front part. A clasp member mounted in the clasp member recess has a pair of resilient arms extending outside the clasp recess halving locking tabs for releasably engaging the locking slots of the receptacle member when the front part of the heel portion abuts against the rear part of the main portion. The clasp member has a retaining member port for receiving a retaining member inserted through the retaining member hole. In this manner, when the front part of the heel portion abuts against the rear part of the main portion, the locking tabs releasably engage with the locking slots, and the retaining member port aligns with the retaining member hole. In this manner, a retaining member can be inserted through the retaining member hole and retained in the retaining member port, so that the heel portion is securely joined to the main portion by both the locking tabs and by the retaining member. Withdrawing the retaining member from the retaining member port and using a tool that extends through the locking slots to press the locking tabs towards each other through the locking tab access holes releases the locking tabs from the locking slots to allow the heel portion to be separated from said main portion.

In another presently preferred embodiment, the invention is a piece of footwear, comprising a heel portion having a receptacle member recess in a front part, and a pair of locking tab access holes in right and left side parts, leading to the receptacle member recess. The locking tab access holes are less than approximately ¼ inch (approximately 60 millimeters) in width, so that the locking tab access holes are too narrow for a child's finger to go through to reach the receptacle recess. A receptacle member mounted in the receptacle member recess has a pair of locking slots formed in opposing sides of the receptacle member, and the locking slots are in communication with the locking tab access holes. A main portion has a clasp member recess in a rear part and a clasp member mounted in the clasp member recess having a pair of resilient arms extending outside the clasp member recess having locking tabs for releasably engaging the locking slots of the receptacle member when the front part of the heel portion abuts against the rear part of the main portion. Thus, when the front part of the heel portion abuts against the rear part of the main portion, the locking tabs releasably engage with the locking slots to securely loin the heel portion to the main portion. Using a tool that extends through the locking tab access holes to press the locking tabs towards each other releases the locking tabs from the locking slots to allow the heel portion to be separated from said main portion.

Preferably, the main portion and the heel portion comprise an elastomeric material, and the receptacle member and the clasp member comprise a resilient material.

In another presently preferred embodiment, the present invention is a piece of footwear, comprising a heel portion having a receptacle recess in a front part, and a pair of locking tab access holes in right and left side parts leading to the receptacle recess, and a retaining member hole in a bottom part, leading to the receptacle recess. The locking tab access holes are less than approximately ¼ inch (approximately 60 millimeters) in diameter, so that the locking tab access holes are too narrow for a child's finger to go through the locking tab access holes to reach the receptacle recess. A receptacle member mounted in the receptacle recess has a pair of locking slots formed in opposing sides of the receptacle member, which are in communication with the locking tab access holes. A main portion has a clasp member recess in a rear part and a clasp member mounted in the clasp member recess having a pair of resilient arms extending outside the clasp recess having locking tabs thereon for releasably engaging the locking slots of the receptacle member when the front part of the heel portion abuts against the rear part of the main portion. The main portion also has a retaining member port for receiving a retaining member inserted through the retaining member hole. When the front part of the heel portion abuts against the rear part of the main portion and the locking tabs releasably engage with the locking slots, the retaining member port aligns with the retaining member hole, so that a retaining member can be inserted through the retaining member hole and retained in the retaining member port, so that the heel portion is securely joined abutting against the main portion by both the locking tabs and the retaining member. Withdrawing the retaining member from the locking member port and the locking member hole, and using a tool that extends through the locking tab access holes to press the locking tabs towards each other through the locking tab access holes releases the locking tabs from the locking slots to allow the heel portion to be separated from the main portion.

In still another presently preferred embodiment, the present invention is a piece of footwear, comprising a heel portion and a main portion. A first of these portions has a pair of locking tab access holes in right and left side parts, leading to a receptacle recess. A receptacle member in the receptacle recess has a pair of locking slots formed in opposing sides of the receptacle member, and the locking slots are in communication with the locking tab access holes. The locking tab access holes are less than approximately ¼ inch (approximately 60 millimeters) in width, so that the locking tab access holes are too narrow for a child's finger to go through to reach the locking slots. A second of the portions has a clasp recess and a clasp member in the clasp recess, having a pair of resilient arms extending outward from the clasp recess, having locking tabs for releasably engaging the locking slots of the receptacle member when the heel portion abuts against the main portion. When the heel portion abuts against the main portion, the locking tabs releasably engage with the locking slots to securely join the heel portion to the main portion. Using a tool that extends through the locking tab access holes to press the locking tabs towards each other releases the locking tabs from the locking slots to allow the heel portion to be separated from the main portion. Preferably, the main portion and the heel portion comprise an elastomeric material, and the receptacle member and the clasp member comprise a resilient material. Preferably, the receptacle member and the clasp member are embedded in the elastomeric material of the main portion and the heel portion.

BEST MODE FOR CARRYING OUT INVENTION

Figure 1:
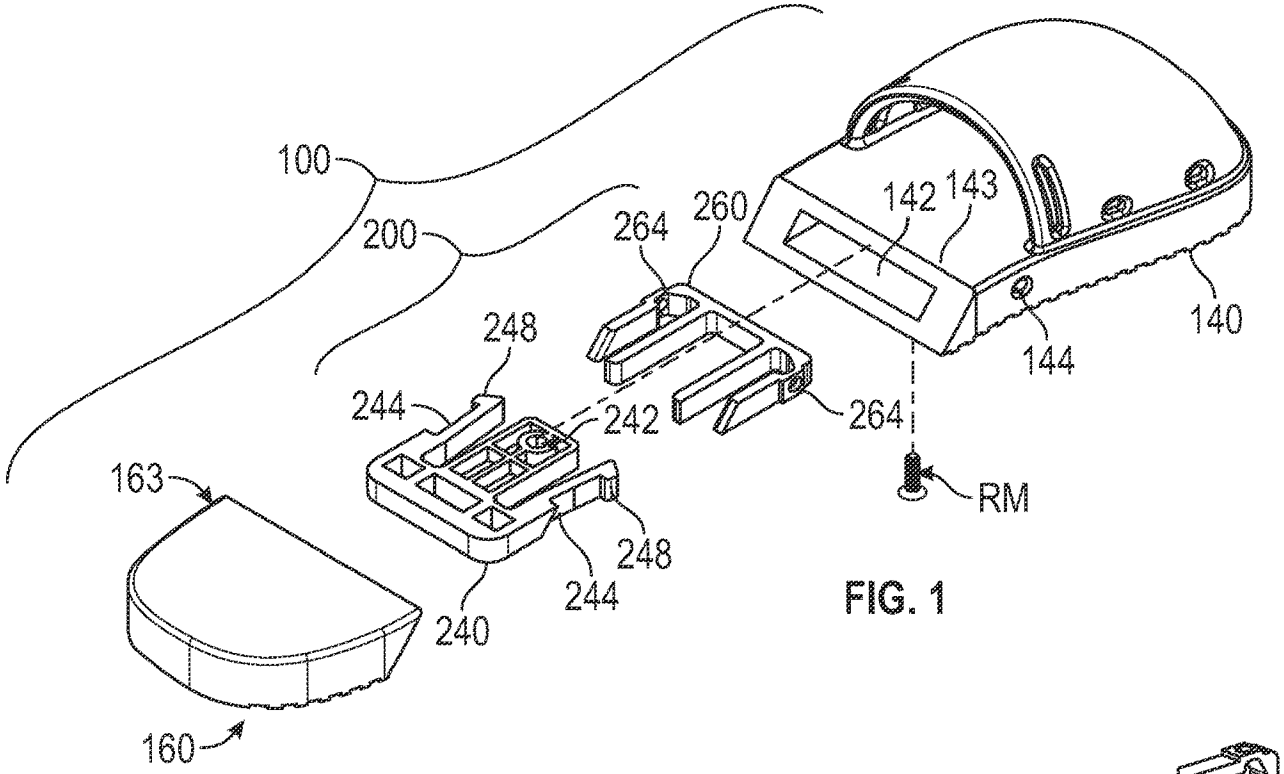
FIG. 1 is a perspective exploded view from above of a left side of footwear according to a presently preferred embodiment of the present invention, showing the joinable and separable cooperating clasp member and receptacle member of a buckle, securely insertable and removable respectively into a heel portion and a main portion of said footwear, and a retaining member positioned for insertion.

The presently preferred best mode for practicing the present invention is illustrated by way of example in FIG. 1, which is an exploded perspective view from above of a left side of footwear 100 according to the present invention, having a main portion 140 and a heel portion 160. The main portion 140 preferably has a receptacle member recess 142 in a rear part 143, and the heel portion 160 preferably has a clasp member recess (not shown) in a front part 163.

A buckle 200 to fasten the heel portion 160 to the main portion 140 together is provided, consisting of a clasp member 240 inserted in the clasp member recess and a receptacle member 260 inserted in the receptacle member recess 142. When the heel portion 160 is brought together with the main portion 140, with the front part 163 of the heel portion 160 abutting against the rear part 143 of the main portion 140, the clasp member 240 becomes engaged with with, and retained in, the receptacle member 260 as described in more detail below, to securely join the heel portion 160 to the main portion 140 together.

The main portion 140 has locking tab access holes 144 in right and left side parts that lead into the receptacle member recess 142. The locking tab access holes are preferably circular in cross section, but can be rectangular or of some other shape in cross section.

Preferably, the locking tab access holes 144 are less than approximately ¼ inch (approximately 60 millimeters) in width, so that the locking tab access holes 144 are too narrow for a child's finger to go through to reach the receptacle recess 142.

Preferably, the main portion 140 also has a retaining member hole 146 in a bottom part (see FIG. 2) leading to the receptacle member recess 142.

The receptacle member 260 mounted in the receptacle recess 142 has a pair of locking slots 264 formed in opposing sides of the receptacle member 260, and the locking slots 264 are in communication with the locking tab access holes 144 when the receptacle member 260 is inserted in the receptacle member recess 142.

The clasp member 240 has a pair of resilient (as defined below) arms 244, each of which has a locking tab 248 that extends outside the clasp member recess, and also has a retaining member port 242, described in more detail below.

When the heel portion 160 is brought together with the main portion 140, with the front part 163 of the heel portion 160 abutting against the rear part 143 of the main portion 140, resilient arms 244 extend into the receptacle member 260 and the locking tabs 248 then become engaged with, and retained in, the locking slots 264 in the receptacle member 260, to fasten the buckle 200 and securely join the heel portion 160 to the main portion 140 together.

As explained in more detail below, if the locking tabs 248 are pushed towards each other, they will become disengaged with the locking slots 264, thereby releasing the buckle 200, allowing the heel portion 160 to be released from the main portion 140.

Preferably, the clasp member 240 and the receptable member 260 are made from a material such as plastic, that is rigid and strong enough to provide rigidity and strength to securely join the heel portion 160 to the main portion 140, yet resilient enough that the locking tabs 248 can be pushed towards each other to disengage from the locking slots 264, to release the buckle 200, allowing the heel portion 160 to be released from the main portion 140. A material that is rigid and strong enough to form the clasp member 240 and the receptacle member 260 so that they can join and separate by pushing the locking tabs 248 towards each other to disengage from the locking slots 264 to release the buckle is called a "resilient" material.

Of course, the clasp member 240 and the receptable member 260 need not be inserted into recesses in the main portion 140 and the heel portion 160, but can instead be embedded in the elastomeric material of the main portion 140 and heel portion 160 when the portions are manufactured, because the clasp member and receptacle member do not need to be removable from the heel portion and main portion.

Thus, the locking tabs 248 releasably engage with the locking slots 264 when the front part 163 of the heel portion 160 abuts against the rear part 143 of the main portion 140.

Figure 17:
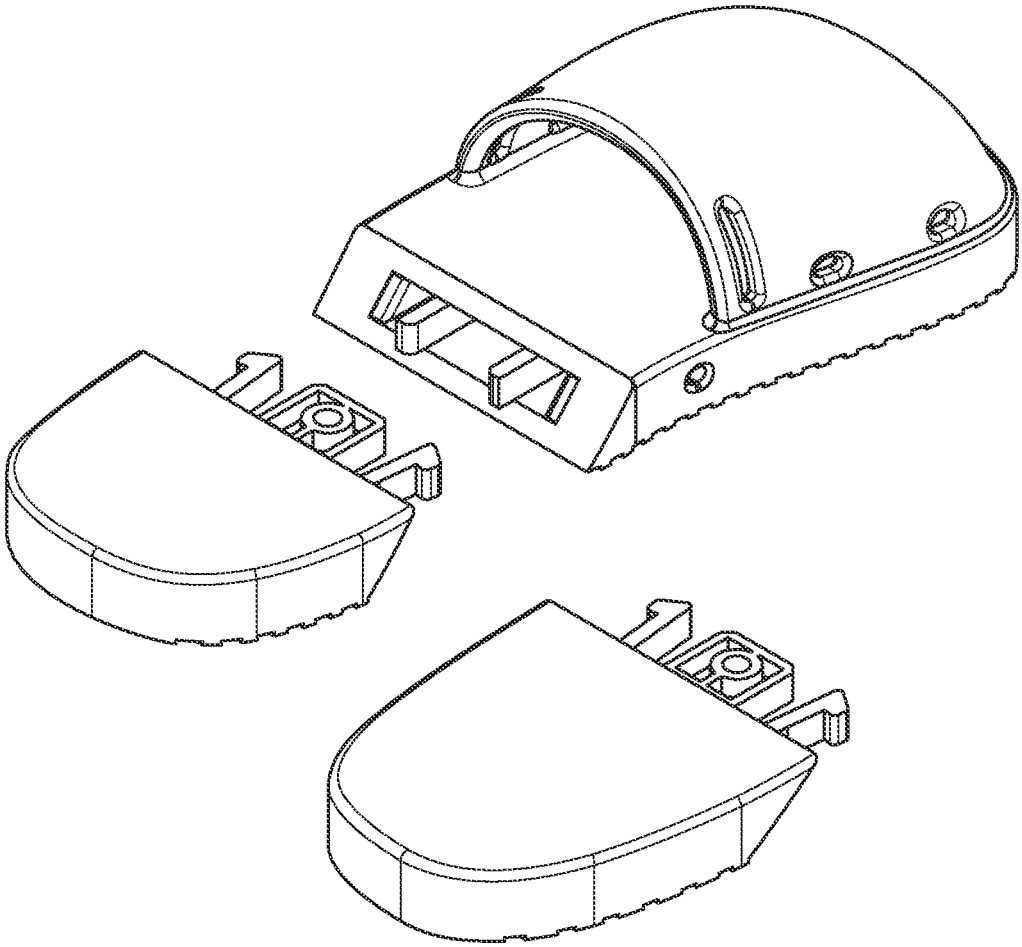
FIG. 17 is a perspective view from the side of the embodiment of FIG. 1 with a plurality of heel portions that can be interchanged.

As shown in FIG. 17, after the heel portion 160 is released from the main portion 140, an alternate heel portion having its own clasp member with locking tabs that can engage with the locking slots 264 can then be interchanged with the original heel portion 160 and securely fastened. The alternate heel portion can be the same size as the heel portion 160, such as, for example, if the heel portion 160 is worn out and it is only desired to replace the worn-out portion. Or the alternate heel portion can be a different size or shape from the heel portion 160, such as, for example, to accommodate a different size foot, or provide a different height, or for different styling, or for other reasons.

Figure 2:
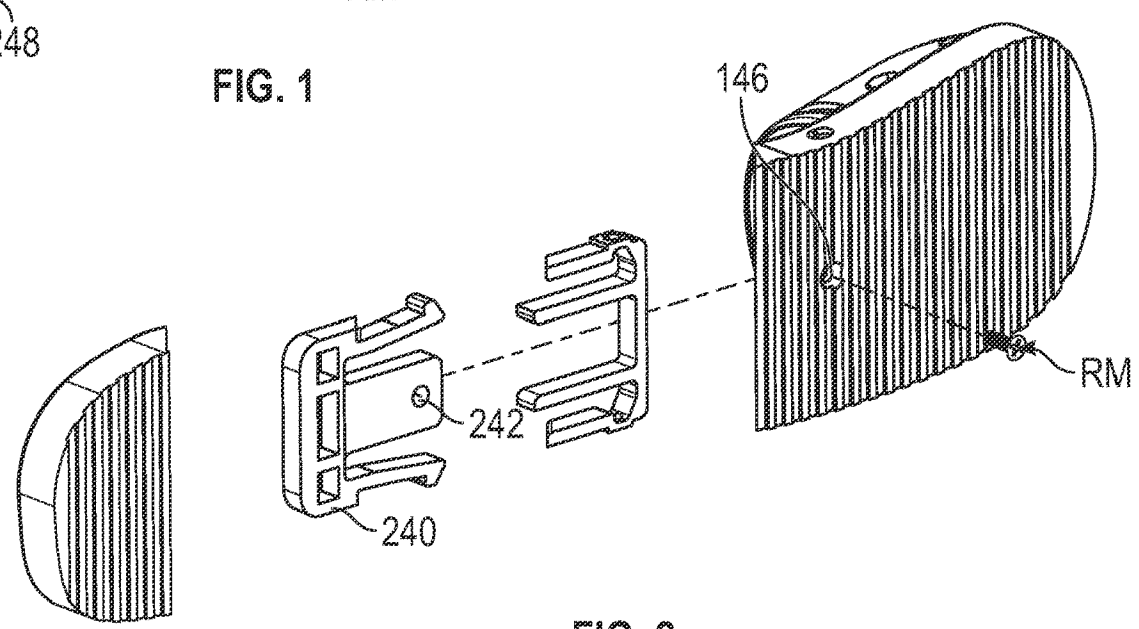
FIG. 2 is a perspective exploded view of the bottom of the embodiment of FIG. 1.

Referring to FIG. 2, shown is a perspective exploded view of the bottom of the embodiment of FIG. 1. As can be seen, preferably the clasp member 240 has a retaining member port 242 for receiving a retaining member RM inserted through the retaining member hole 146 to additionally secure the heel portion 160 to the main portion 140. Preferably, the retaining member is a screw that can be inserted through the retaining member hole 146 and screwed into the retaining member port 242.

Figure 3:
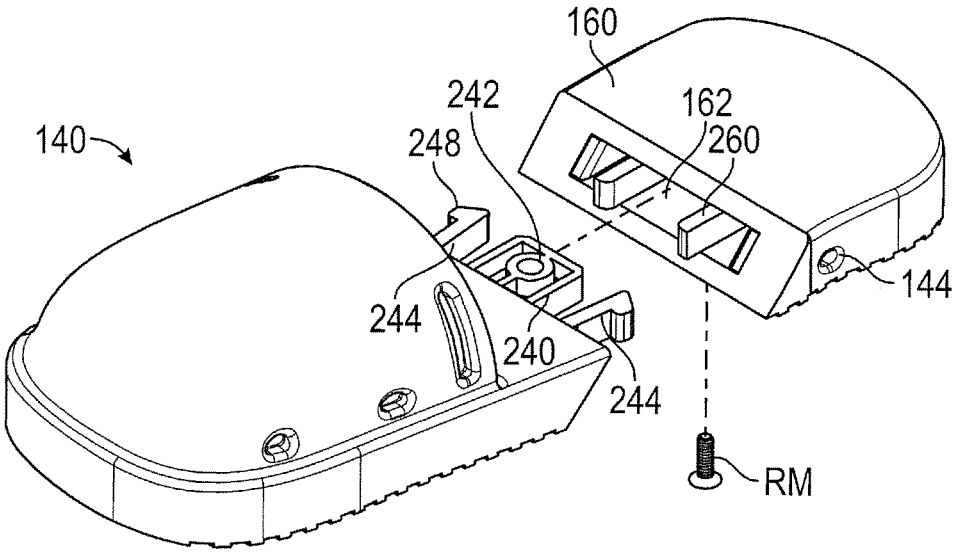
FIG. 3 is a perspective separated view from above of an alternative embodiment of the present invention, with the clasp member and receptable member of the buckle inserted into the main portion and heel portion of the footwear, respectively, showing the heel portion separated from the main portion, ready to be joined together by the buckle, and the retaining member positioned for insertion.

Referring to FIG. 3, shown is a perspective separated view from above of an alternative embodiment of the present invention, with the clasp member 240 having arms 244 inserted into a clasp member recess (not shown) in the main portion 140, and the receptable member 260 inserted into a receptacle member recess 162 in the heel portion 160, so that the clasp member 240 and receptacle member 260 are ready to be joined together, with the retaining member RM positioned for insertion. As can be seen, because the clasp member 240 and receptacle member 260 are made of resilient material, and also span across a substantial portion of the heel portion 160 and the main portion 140, when the clasp member 240 and receptacle member 260 are joined together to form the buckle 200, they prevent twisting of the heel portion 160 with respect to the main portion 140, and also make the footwear stronger than if it were made purely of elastomeric material.

Figure 4:
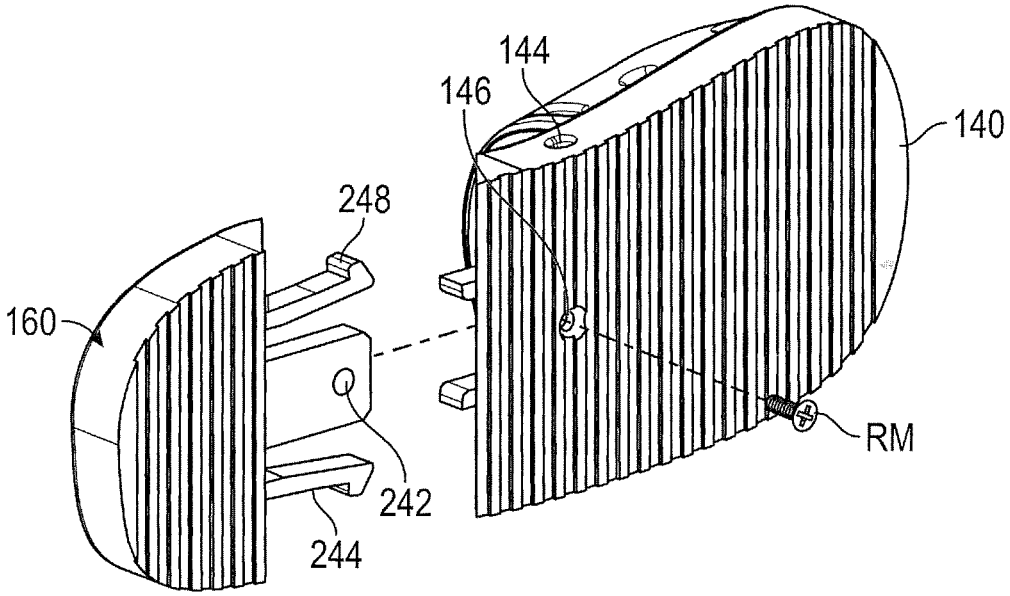
FIG. 4 is a perspective separated view of the bottom of the embodiment of FIG. 1, with the clasp member and receptable member of the buckle inserted into the heel portion and main portion of the footwear, respectively, showing the heel portion separated from the main portion, ready to be joined together by the buckle, and the retaining member positioned for insertion.

Referring to FIG. 4, shown is a perspective separated view of the bottom of the embodiment of FIG. 1, showing the heel portion 160 separated from the main portion 140, ready to be joined together, and the retaining member RM positioned for insertion through the retaining member hole 146 and into the retaining member port 242.

It is preferred that the main portion 140 and the heel portion 160 both be provided with non-slip soles.

Figure 5:
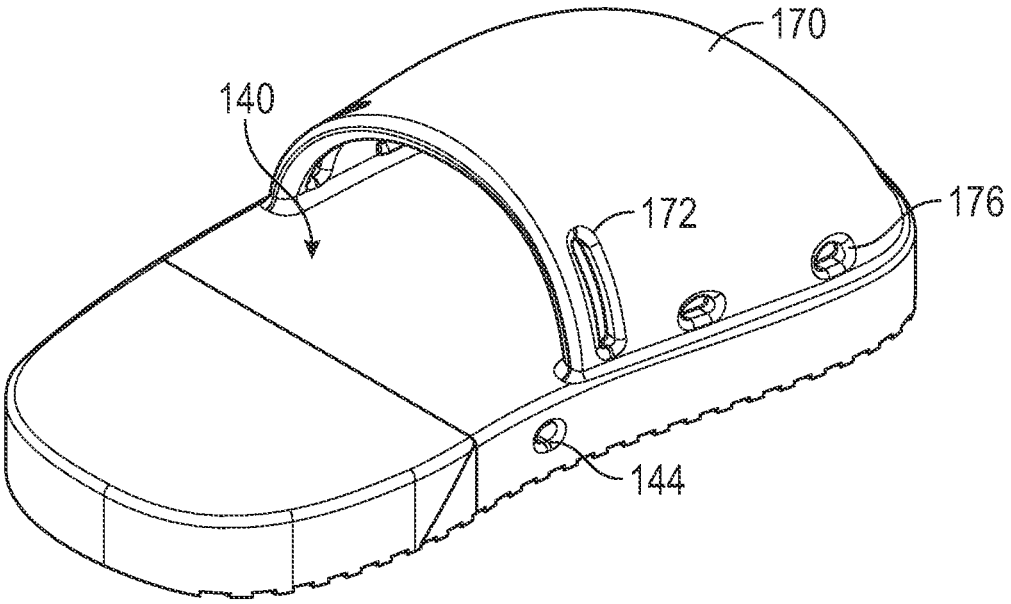
FIG. 5 is a perspective joined view from above of the embodiment of FIG. 1, with the interchangeable heel portion securely joined to the main portion by the buckle (not shown).

Referring to FIG. 5, shown is a perspective joined view from above of the embodiment of FIG. 1, with the interchangeable heel portion joined to the main portion by the buckle (not shown). As can be seen, a domed cover 170 for protection of the toes can be attached to the main portion 140, having strap slots 172 for attachment of removable straps. Gaps 176 can also be provided along the base of the domed cover 170 for ventilation and air flow.

Figure 6:
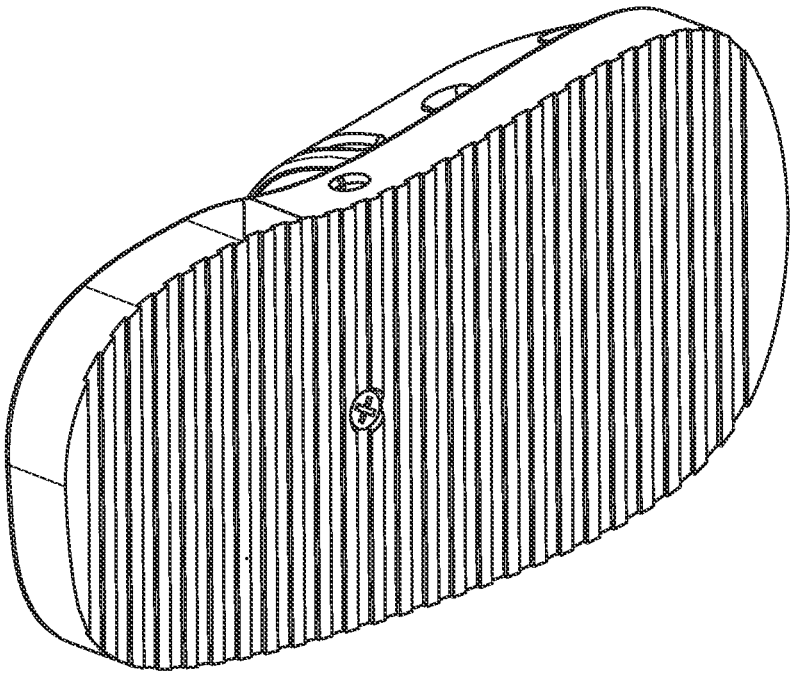
FIG. 6 is a perspective joined view of the bottom the embodiment of FIG. 1, with the heel portion joined to the main portion by the buckle (not shown) and the retaining member inserted.

Referring to FIG. 6, shown is a perspective joined view of the bottom the embodiment of FIG. 1, with the interchangeable heel portion securely joined to the main portion by the buckle (not shown) and the retaining member RM inserted.

Figure 7:
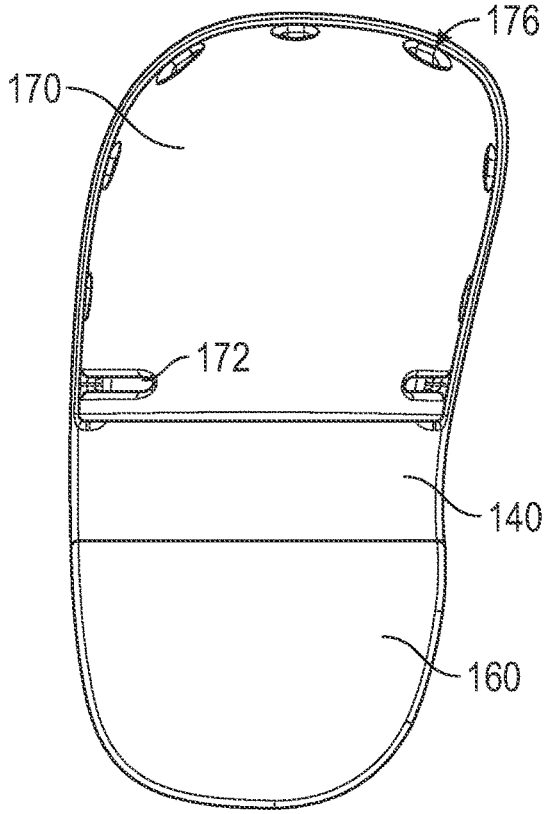
FIG. 7 is a top plan joined view of the embodiment of FIG. 1.

Referring to FIG. 7, shown is a top plan joined view of the embodiment of FIG. 1.

Figure 8:
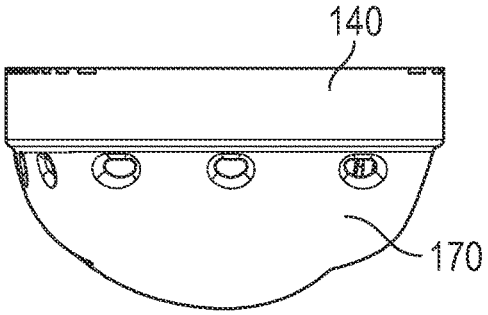
FIG. 8 is an elevational joined view from the front of the embodiment of FIG. 1.

Referring to FIG. 8 shown is an elevational joined view from the front of the embodiment of FIG. 1.

Figure 9:
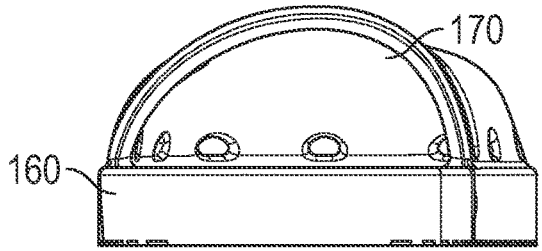
FIG. 9 is an elevational joined view from the rear of the embodiment of FIG. 1.

Referring to FIG. 9, shown is an elevational joined view from the rear of the embodiment of FIG. 1.

Figure 10:
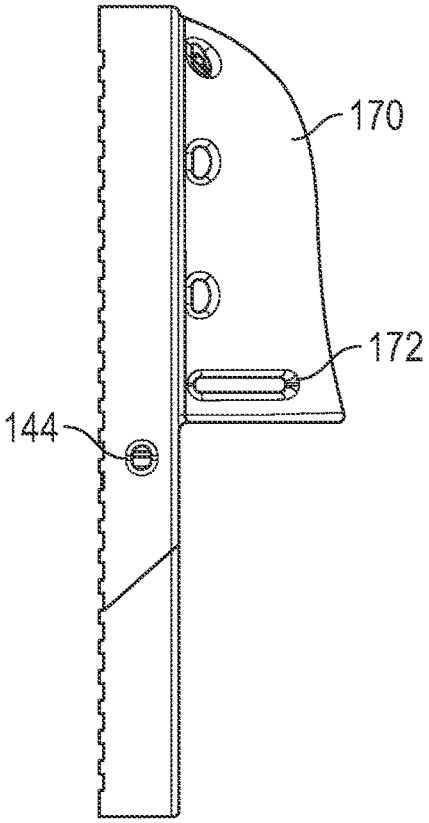
FIG. 10 is an elevational joined view from the left side of the embodiment of FIG. 1.

Referring to FIG. 10, shown is an elevational joined view from the left side of the embodiment of FIG. 1.

Figure 11:
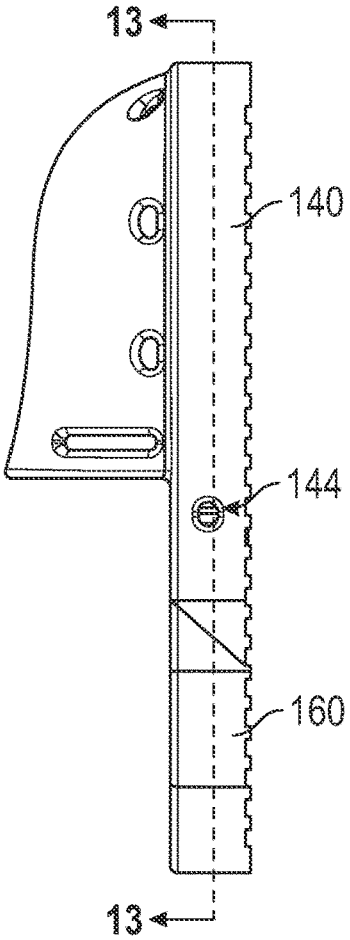
FIG. 11 is an elevational joined view from the right side of the embodiment of FIG. 1.

Referring to FIG. 11, shown is an elevational joined view from the right side of the embodiment of FIG. 1.

Figure 12:
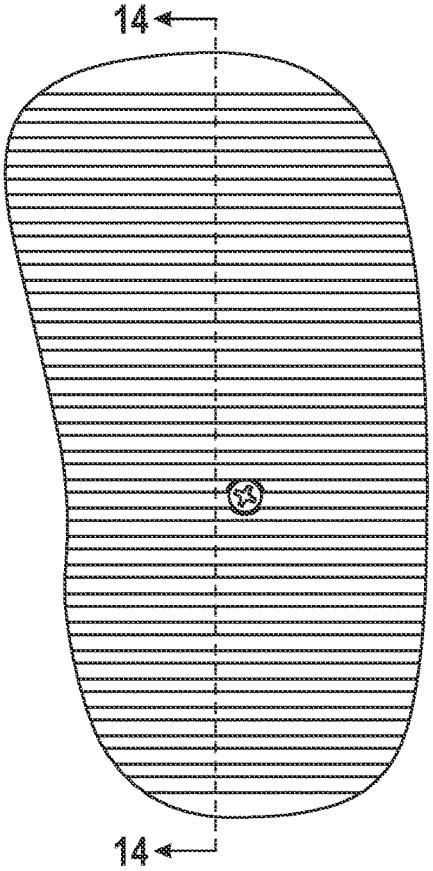
FIG. 12 is a plan joined view of the bottom of the embodiment of FIG. 1.

Referring to FIG. 12, shown is a plan joined view of the bottom of the embodiment of FIG. 1.

Figure 13:
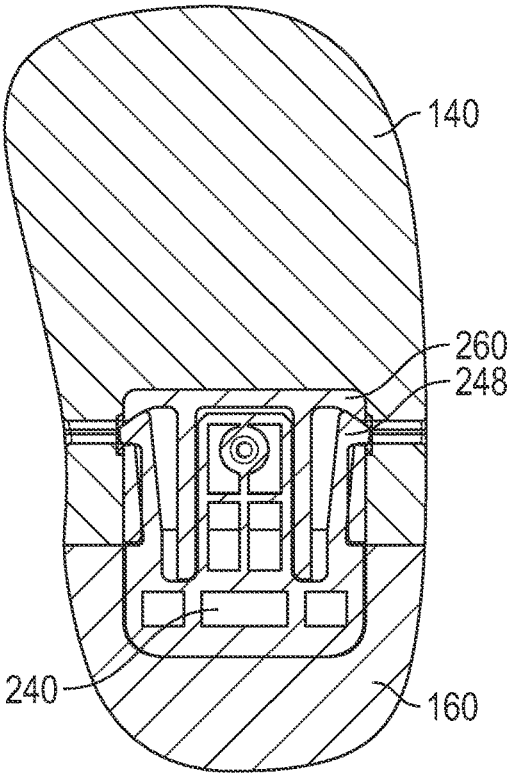
FIG. 13 is an plan joined cutaway view of the bottom of the embodiment of FIG. 1, along the line 13-13 of FIG. 11.

Referring to FIG. 13, shown is a plan joined cutaway view of the bottom of the embodiment of FIG. 1, along the line 13-13 of FIG. 11.

Figure 14:
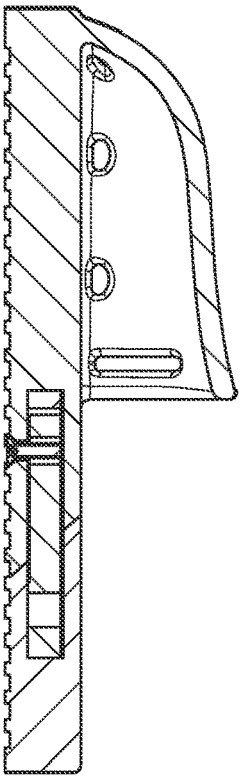
FIG. 14 is an elevational joined cutaway view of the left side along the line 14-14 of FIG. 12.

Referring to FIG. 14, shown is an elevational joined cutaway view of the left side along the line 14-14 of FIG. 12.

Figure 15:
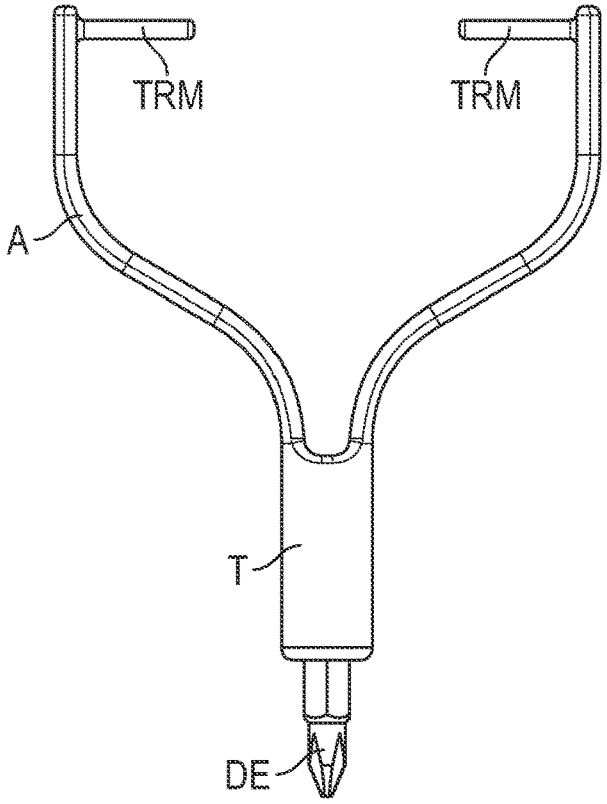
FIG. 15 is a side view of a first preferred embodiment of a tool that can be used to separate the clasp member and receptacle member of the buckle where locking tab access holes have a round cross section.

Referring to FIG. 15, shown is a side view of a first preferred embodiment of a tool T that can be used to separate the clasp member 240 and receptacle member 260 of the buckle 200 where locking tab access holes 144 have a round cross section. The driver end DE of the tool T preferably has the configuration of a screwdriver that can drive the retaining member RM, which is preferably in the configuration of a screw. Two opposing arms A extend from the end opposite the driver end DE and are provided with tab release members TRM that are configured to pass completely through the locking tab access holes 144 so as to be able to press the locking tabs 248 together simultaneously, so as to disengage both of the locking tabs 248 from the locking slots 264 simultaneously, thereby releasing the clasp member 240 from the receptacle member 260, to allow the heel portion 160 to be separated from the main portion 140. The arms A preferably comprise a material that is sufficiently flexible that the arms A can be bent to insert the tab release members TRM into both locking tab access holes 144 simultaneously, and then to squeeze the tab release members TRM together to press the locking tabs 248 together and release them from the locking slots 264. However, it is not necessary that the arms A be made of a rigid or resilient material, nor is it necessary that a driver end DE that can drive the retaining member RM be provided on the tool T.

Figure 16:
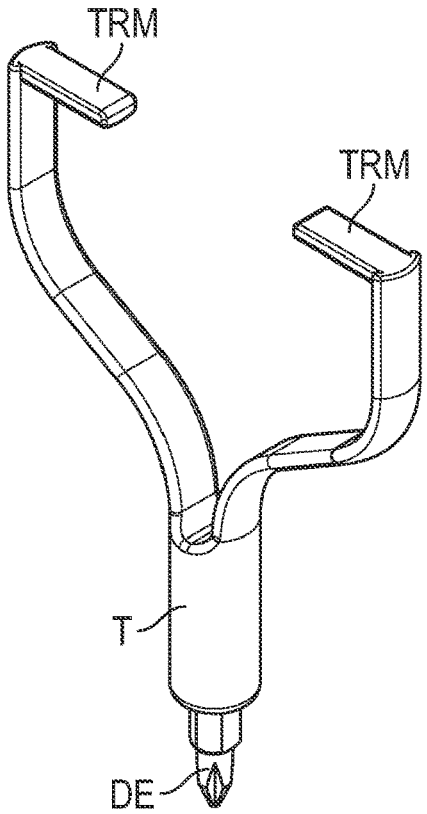
FIG. 16 is a perspective view from the side of an alternative preferred embodiment of a tool that can be used to separate the clasp member and the receptable member of the buckle where locking tab access holes have a rectangular cross section.

FIG. 16 is a perspective view from the side of an alternative preferred embodiment of a tool T that can be used to separate the clasp member 240 from the receptable member 260 of the buckle 200 where the locking tab access holes 144 have a rectangular cross section. As can be seen, the tab release members TRM have a rectangular cross section.

Referring to FIG. 17, shown is a perspective view from the side of the embodiment of FIG. 1, with a plurality of heel portions that can be interchanged. Because heel portions can be interchanged as children grow or as heel portions become worn out, this footwear can be less expensive for parents who cannot afford to purchase new footwear as children grow or their footwear is worn out, because the parents need only purchase replacement heel portions, of the same or different sizes or styles (or other properties), which replacement heel portions can be sold separately from the main portion.

While the present invention has been disclosed in connection with the presently preferred embodiments described herein, it should be understood that there may be other embodiments which fall within the spirit and scope of the invention as defined by the appended claims. For example, the clasp member can be in the main portion and the receptacle member can be in the heel portion. For another example, different structures of buckles can be used, as long as the buckle has a clasp member and a receptacle member, where the clasp member has locking tabs that engage with locking slots in the receptacle member, to securely join the heel portion and the main portion when they are abutting, and the buckle can be released by a tool that extends through locking tab access holes in the receptacle member to push the locking tabs together to disengage the locking tabs from the locking slots. Accordingly, no limitations are to be implied or inferred in this invention except as specifically and as explicitly set forth in the appended claims.

INDUSTRIAL APPLICABILITY

The present invention is applicable whenever it is desired to provide elastomeric footwear to children with a securely interchangeable heel portion.

What is claimed is:

1. A piece of footwear, comprising:

a main portion having a receptacle recess in a rear part, and a pair of locking tab access holes in right and left side parts leading to said receptacle recess, and a retaining member hole in a bottom part, leading to said receptacle recess;

wherein said locking tab access holes are less than approximately ¼ inch in diameter, whereby said locking tab access holes are too narrow for a child's finger to go through said locking tab access holes to reach said receptacle recess;

a receptacle member mounted in said receptacle recess having a pair of locking slots formed in opposing sides of said receptacle member, said locking slots in communication with said locking tab access holes;

a heel portion having a clasp member recess in a front part;

a clasp member mounted in said clasp member recess having a pair of resilient arms extending outside said clasp recess having locking tabs thereon for releasably engaging said locking slots of said receptacle member when said front part of said heel portion abuts against said rear part of said main portion, and having a retaining member port for receiving a retaining member inserted through said retaining member hole;

whereby when said front part of said heel portion abuts against said rear part of said main portion, said locking tabs releasably engage with said locking slots, said retaining member port aligns with said retaining member hole, whereby a retaining member can be inserted through said retaining member hole and retained in said retaining member port, so that said heel portion is securely joined to said main portion by both said locking tabs and by said retaining member;

whereby withdrawing said retaining member from said retaining member port and using a tool that extends through said locking slots to press said locking tabs towards each other through said locking tab access holes releases said locking tabs from said locking slots to allow said heel portion to be separated from said main portion.

2. A piece of footwear according to claim 1, wherein said main portion and said heel portion comprise an elastomeric material, and said receptacle member and said clasp member comprise a resilient material.

3. A piece of footwear, comprising:

a heel portion having a receptacle recess in a front part, and a pair of locking tab access holes in right and left side parts leading to said receptacle recess, and a retaining member hole in a bottom part, leading to said receptacle recess;

wherein said locking tab access holes are less than approximately ¼ inch in diameter, whereby said locking tab access holes are too narrow for a child's finger to go through said locking tab access holes to reach said receptacle recess;

a receptacle member mounted in said receptacle recess having a pair of locking slots formed in opposing sides of said receptacle member, said locking slots in communication with said locking tab access holes;

a main portion having a clasp member recess in a rear part;

a clasp member mounted in said clasp member recess having a pair of resilient arms extending outside said clasp recess having locking tabs thereon for releasably engaging said locking slots of said receptacle member when said front part of said heel portion abuts against said rear part of said main portion, and having a retaining member port for receiving a retaining member inserted through said retaining member hole;

whereby when said front part of said heel portion abuts against said rear part of said main portion and said locking tabs releasably engage with said locking slots, said retaining member port aligns with said retaining member hole, whereby a retaining member can be inserted through said retaining member hole and retained in said retaining member port, so that said heel portion is securely joined abutting against said main portion by both said locking tabs and said retaining member;

whereby withdrawing said retaining member from said locking member port and said locking member hole, and using a tool that extends through said locking slots to press said locking tabs towards each other through said locking tab access holes releases said locking tabs from said locking slots to allow said heel portion to be separated from said main portion.

4. A piece of footwear according to claim 3, wherein said main portion and said heel portion comprise an elastomeric material, and said receptacle member and said clasp member comprise a resilient material.

5. A piece of footwear according to claim 4, wherein said receptacle member and said clasp member are embedded in said elastomeric material of said main portion and said heel portion.

* * * * *